US009908013B2

(12) United States Patent
Hettinger et al.

(10) Patent No.: US 9,908,013 B2
(45) Date of Patent: Mar. 6, 2018

(54) GOLF CLUB HAVING CONCENTRATED WEIGHTING

(71) Applicant: Acushnet Company, Fairhaven, MA (US)

(72) Inventors: Ronald K. Hettinger, Oceanside, CA (US); Uday V. Deshmukh, Carlsbad, CA (US); Gentry Ferguson, Encinitas, CA (US); Eddie G. Perez, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 14/985,043

(22) Filed: Dec. 30, 2015

(65) Prior Publication Data

US 2017/0189770 A1 Jul. 6, 2017

(51) Int. Cl.
*A63B 53/04* (2015.01)

(52) U.S. Cl.
CPC .. *A63B 53/0466* (2013.01); *A63B 2053/0491* (2013.01)

(58) Field of Classification Search
CPC ..... A63B 53/0466; A63B 2053/0491; A63B 53/0487; A63B 53/06; A63B 53/08
See application file for complete search history.

(56) References Cited

U.S. PATENT DOCUMENTS 1,534,600 A 4/1925 Mattern
5,297,794 A 3/1994 Lu
5,482,281 A * 1/1996 Anderson ..... A63B 53/0487 473/313
5,518,243 A 5/1996 Redman
5,720,674 A 2/1998 Galy
5,935,019 A 8/1999 Yamamoto
5,947,840 A 9/1999 Ryan
5,967,905 A 10/1999 Nakahara et al.
6,056,649 A 5/2000 Imai
6,123,627 A 9/2000 Antonious
6,217,461 B1 4/2001 Galy
6,379,265 B1 4/2002 Hirakawa et al.
6,860,818 B2 3/2005 Mahaffey et al.
6,988,960 B2 1/2006 Mahaffey et al.
7,153,220 B2 12/2006 Lo
7,294,065 B2 11/2007 Liang et al.
7,717,804 B2 5/2010 Beach et al.
8,292,757 B2 10/2012 Soracco
8,388,465 B2 3/2013 De La Cruz et al.
8,540,589 B2 9/2013 Bezilla et al.
8,684,863 B2 4/2014 Bezilla et al.
9,033,822 B1 * 5/2015 DeMille ..... A63B 53/0466 473/345
9,089,748 B2 7/2015 Morales
(Continued)

OTHER PUBLICATIONS

U.S. Appl. No. 14/271,580, filed May 7, 2014, Golden et al.
(Continued)

*Primary Examiner* — Steven Wong
(74) *Attorney, Agent, or Firm* — Michael J. Mancuso

(57) ABSTRACT

A golf club head including a multi-piece construction. The golf club head includes a plurality of body components coupled at a seam. A weight member is coupled to the golf club head so that it overlaps a seam.

5 Claims, 8 Drawing Sheets

(56) References Cited

U.S. PATENT DOCUMENTS

2001/0001302 A1* 5/2001 Murphy ..... A63B 53/04 473/345
2002/0019267 A1* 2/2002 Cackett ..... A63B 53/02 473/345
2002/0055393 A1* 5/2002 Reyes ..... A63B 53/02 473/305
2003/0134690 A1* 7/2003 Chen ..... A63B 53/04 473/345
2005/0215350 A1* 9/2005 Reyes ..... A63B 53/0466 473/344
2006/0052185 A1* 3/2006 Kawaguchi ..... A63B 53/0466 473/349
2008/0139339 A1* 6/2008 Cheng ..... A63B 55/53 473/346
2009/0143167 A1* 6/2009 Evans ..... A63B 53/0466 473/335
2009/0258726 A1* 10/2009 Abe ..... A63B 53/0466 473/345
2010/0041490 A1* 2/2010 Boyd ..... A63B 53/0466 473/288
2010/0151964 A1* 6/2010 Soracco ..... A63B 53/0466 473/346
2011/0256954 A1* 10/2011 Soracco ..... A63B 53/0466 473/328
2012/0064991 A1* 3/2012 Evans ..... A63B 53/0466 473/335
2013/0178306 A1* 7/2013 Beno ..... A63B 53/06 473/307
2013/0252755 A1* 9/2013 Soracco ..... A63B 53/06 473/324
2014/0162809 A1* 6/2014 Soracco ..... A63B 60/54 473/332
2016/0317880 A1* 11/2016 Boggs ..... A63B 53/0466
2016/0332040 A1* 11/2016 Lafortune ..... A63B 53/04
2017/0021239 A1* 1/2017 Stokke ..... A63B 53/0466

OTHER PUBLICATIONS

U.S. Appl. No. 14/479,153, filed Sep. 5, 2014, Galvan et al.
U.S. Appl. No. 14/581,917, filed Dec. 23, 2014, Bennett et al.
U.S. Appl. No. 14/616,582, filed Feb. 6, 2015, Bezilla et al.
U.S. Appl. No. 14/665,329, filed Mar. 23, 2015, Knutson et al.
U.S. Appl. No. 14/788,243, filed Jun. 30, 2015, Cleghorn et al.
U.S. Appl. No. 14/932,061, filed Nov. 4, 2015, Zimmerman et al.
U.S. Appl. No. 14/944,465, filed Nov. 18, 2015, Bennett et al.
U.S. Appl. No. 14/946,444, filed Nov. 19, 2015, Knutson et al.
U.S. Appl. No. 14/958,801, filed Dec. 3, 2015, Barksdale et al.
U.S. Appl. No. 14/977,116, filed Dec. 21, 2015, Luttrell et al.
U.S. Appl. No. 14/979,151, filed Dec. 22, 2015, Frame et al.
U.S. Appl. No. 14/982,730, filed Dec. 29, 2015, Golden et al.

* cited by examiner

GOLF CLUB HAVING CONCENTRATED WEIGHTING

FIELD OF THE INVENTION

The invention relates to golf clubs, and more particularly, to golf club heads having concentrated weighting.

BACKGROUND OF THE INVENTION

The trend of lengthening golf courses to increase their difficulty has resulted in a high percentage of amateur golfers constantly searching for ways to achieve more distance from their golf shots. The golf industry has responded by providing golf clubs specifically designed with distance and accuracy in mind. The size of wood-type golf club heads has generally been increased while multi-material construction and reduced wall thicknesses have been included to provide more mass available for selective placement through the head. The discretionary mass placement has allowed the club to possess a higher moment of inertia (MOI), which translates to a greater ability to resist twisting during off-center ball impacts and less of a distance penalty for those off-center ball impacts.

Various methods are used to selectively locate mass throughout golf club heads, including thickening portions of the body casting itself or strategically adding separate weight elements during the manufacture of the club head. An example, shown in U.S. Pat. No. 7,186,190, discloses a golf club head comprising a number of moveable weights attached to the body of the club head. The club head includes a number of threaded ports into which the moveable weights are screwed. Though the mass characteristics of the golf club may be manipulated by rearranging the moveable weights, the cylindrical shape of the weights and the receiving features within the golf club body necessarily moves a significant portion of the mass toward the center of the club head, which may not maximize the peripheral weight of the club head or the MOI.

Alternative approaches for selectively locating mass in a club head utilize composite multi-material structures. These composite structures utilize two, three, or more materials that have different physical properties including different densities. An example of this type of composite club head is shown in U.S. Pat. No. 5,720,674. The club head comprises an arcuate portion of high-density material bonded to a recess in the back-skirt. Because composite materials like those found in the club head must be bonded together, for example by welding, swaging, or using bonding agents such as epoxy, they may be subject to delamination or corrosion over time. This component delamination or corrosion results in decreased performance in the golf club head and can lead to club head failure.

Though many methods of optimizing the mass properties of golf club heads exist, there remains a need in the art for a golf club head comprising at least a weight having secure attachment and a low-profile so that the weight does not protrude into the center of the club head and negatively affect the location of the center of gravity and the values of the moments of inertia.

SUMMARY OF THE INVENTION

The present invention is directed to a golf club head having a portion comprising at least one concentrated weight member. The weight member is preferably located toward the back of the sole and may be substantially centered between the heel and toe of the club head. Alternatively, the weight member may be situated toward the back and heel or toward the back and toe of the club head, depending on the desired mass characteristics, e.g., center of gravity, loft and moment of inertia, of the club head.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

The golf club head of the present invention is preferably hollow, such as a metal wood type golf club head, but may include any club head type, such as iron-type club heads. The golf club head generally includes a hosel, a hitting face, a crown, a sole, and a skirt that combine to define a hollow interior cavity.

The inventive golf club head is constructed from a plurality of body components and the components are coupled to form a seam. The golf club head includes at least one weight member that is coupled to the golf club head so that it overlaps and may be integrated into the seam. The embodiments described below are generally illustrated so that the weight member is attached at a seam between a crown component and a sole component, but the following disclosure is not intended to be limited to that configuration. As will be appreciated by a person having ordinary skill, the teachings of the present embodiment apply to attachment of weight members at seams formed between any components of a golf club head.

Figure 1:
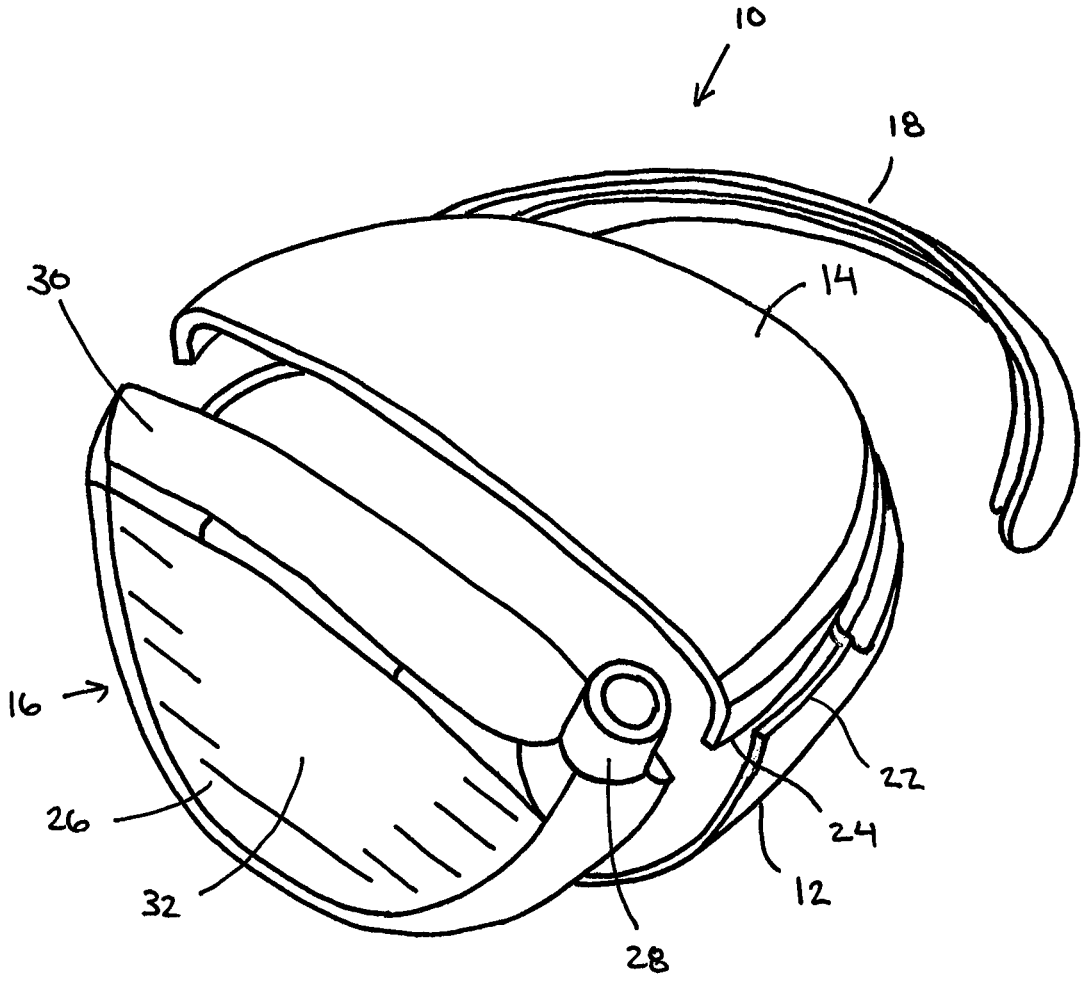
FIG. 1 is a perspective exploded view of a golf club head of the present invention including a weight member.
Figure 2:
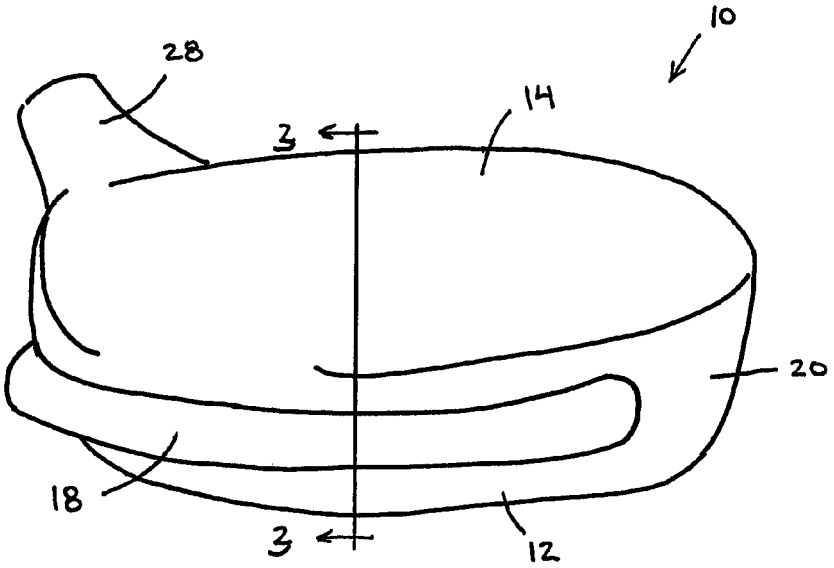
FIG. 2 is a rear view of the golf club head of FIG. 1.
Figure 3:
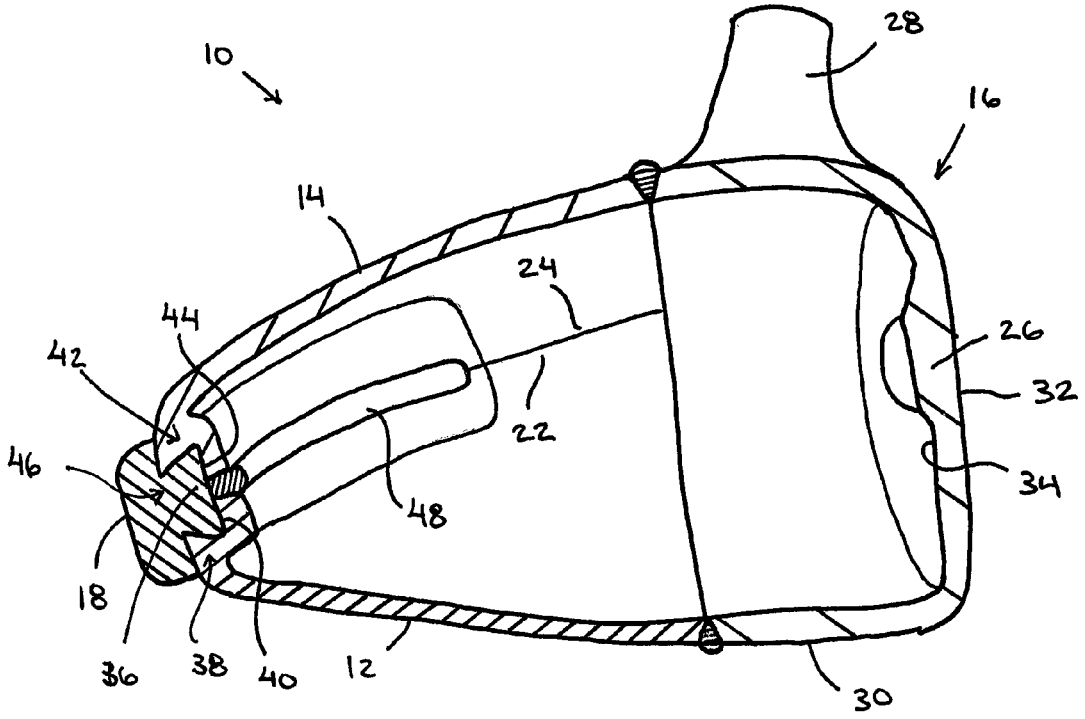
FIG. 3 is a cross-sectional view of the golf club head and weight member, as shown by line 3-3 of FIG. 2.

An exemplary club head including a multi-piece construction is shown FIGS. 1-3. Golf club head 10 generally includes a sole member 12, a crown member 14, a hitting face member 16 and a weight member 18 that are joined to form a hollow bodied golf club head. Sole member 12 generally provides a sole surface and at least a portion of a skirt 20 of the golf club head 10, and includes a perimeter edge 22. The sole surface is generally a portion of the golf club head that is closest to the ground when the golf club head is in an address position and in many embodiments is configured to interact with the ground during a golf swing. Crown member 14 forms an upper surface of golf club head 10 and includes a perimeter edge 24 that is at least partially joined with sole member 12 at perimeter edge 22 to form a seam.

Hitting face member 16 includes a face 26, a hosel 28 and a transition 30. Face 26 forms a front wall of golf club head 10 and defines a front ball-striking surface 32 and a rear face surface 34. The transition 30 extends rearward from a perimeter of face 26 and forms a portion of each of the crown, sole and skirt of the assembled golf club head. Hosel 28 extends from the crown portion of transition and provides an attachment feature for a golf club shaft.

In the embodiment shown, the combination of face 26, hosel 28 and transition 30 form a face cup that is combined with an aft portion to form the assembled golf club head. As illustrated, the aft portion is formed by a combination of the separate sole and crown members 12, 14 that are joined along a seam that generally extends around a portion of the perimeter of the golf club head.

Weight member 18 is a concentrated mass piece that is coupled to the golf club body so that it overlaps the seam, and in the present embodiment is integrated into the seam. In particular, the seam creates a mechanical lock for retaining weight member 18. In particular, weight member 18 includes a flange 36 that extends into and is coupled to the head at the seam between sole member 12 and crown member 14. Flange 36 of weight member 18 is an elongate extension of weight member 18 that forms an elongate dovetail on a wall of weight member 18.

Sole member 12 includes a sole weight flange 38 on a portion of the perimeter 22. The flange 38 forms a shoulder 40 that is recessed toward the interior of the golf club head. Similarly, crown member 14 includes a crown weight flange 42 on a portion of perimeter 24, and flange 42 forms a shoulder 44 that is recessed toward the interior of the golf club head. The sole shoulder 40 and the crown shoulder 44 combine to form an elongate undercut channel 46 that complements the shape of flange 36 and receives flange 36 of weight member 18.

In a method of manufacturing golf club head 10, the sole member 12 and the crown member 14 are oriented so that the perimeters of the components are located adjacent each other. In that orientation, the shoulders of the sole member and the crown member align to form an elongate weight recess, which is formed as an undercut channel with flange 36 of weight member 18 disposed in the undercut channel. The perimeters of the sole member and the crown member are joined, such as by weld 48. The weld 48 couples the perimeters of sole member 12 and crown member 14 while trapping flange 36 in the undercut channel. It should be appreciated that, in embodiments utilizing a material for weight member 18 that is weldable to the sole member and crown member, the weld 48 may also directly fasten the weight member 18 to the sole and crown members.

Figure 4:
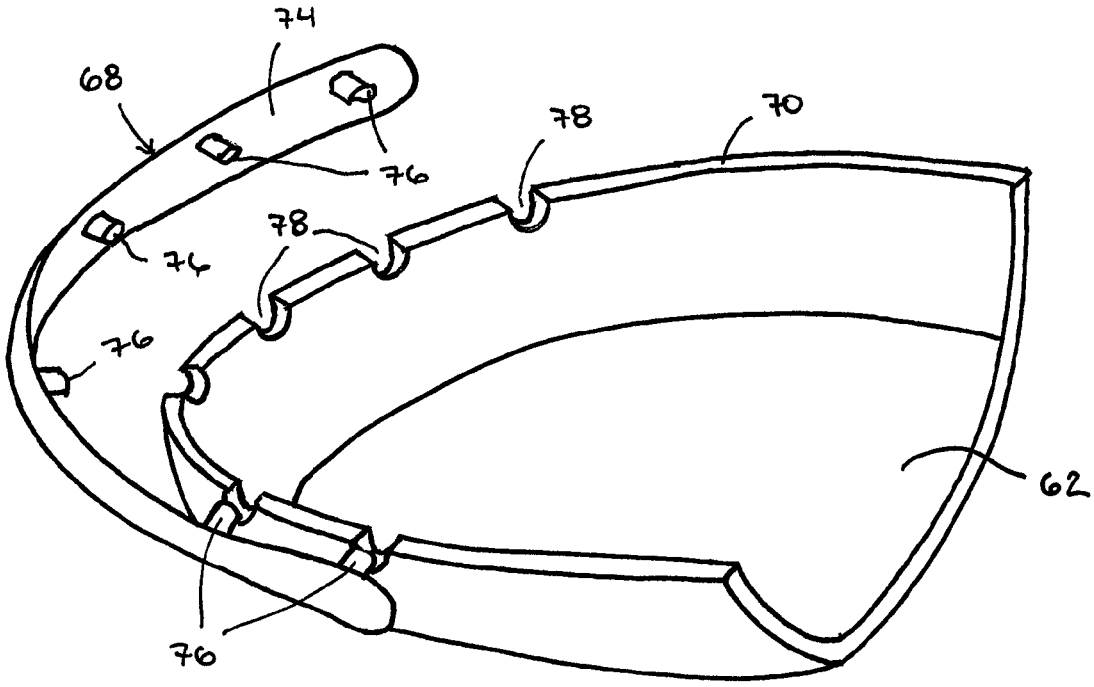
FIG. 4 is a perspective view of an alternative construction of a sole member and weight member.
Figure 5:
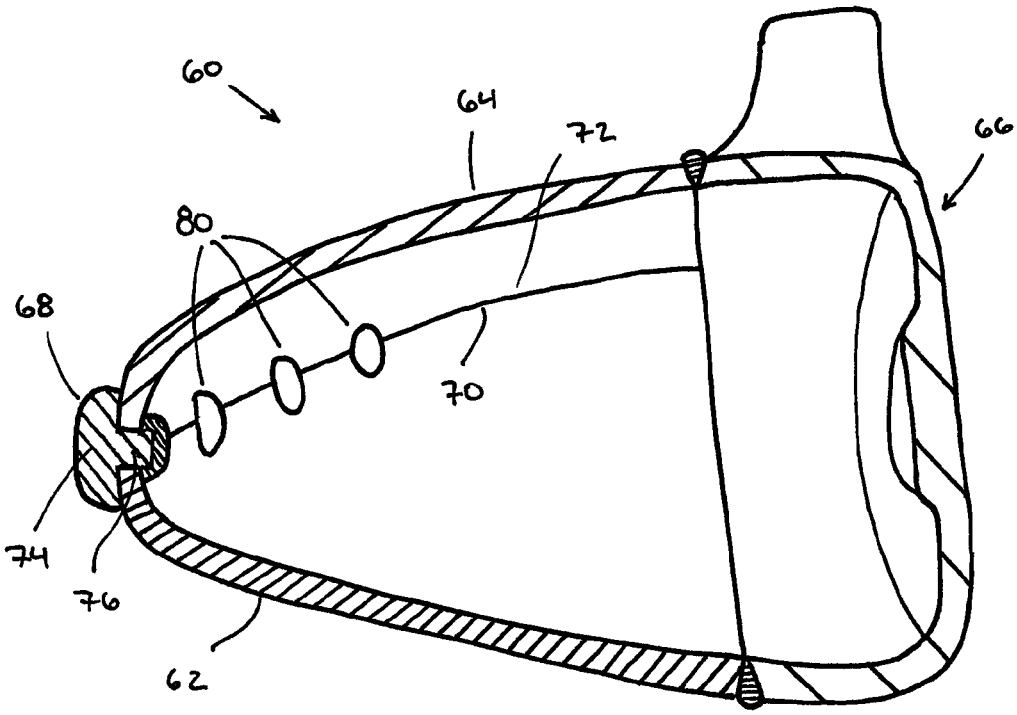
FIG. 5 is a cross-sectional view of a golf club head including the sole member and weight member of FIG. 4.

In another embodiment, illustrated in FIGS. 4 and 5, a golf club head includes a weight member that is coupled to the golf club head with an alternative configuration. In particular, golf club head 60 includes a sole member 62, a crown member 64, a hitting face member 66, and a weight member 68 that are joined to form a hollow bodied golf club head. Sole member 62 generally provides a sole surface of the golf club head 60, and includes a perimeter edge 70. Crown member 64 forms an upper surface of golf club head 60 and includes a perimeter edge 72 that is at least partially joined with sole member 62 at perimeter edge 70 to form a seam. The face member 66 has a cup-face construction similar to that described with regard to golf club head 10.

Weight member 68 is a concentrated mass piece that is coupled to the golf club body so that it overlaps the seam, and in the present embodiment is integrated into the seam. Weight member 68 includes an elongate body 74 and a plurality of posts 76. Sole member 62 includes a plurality of recesses 78 that at least partially receive posts 76. Crown member 64 may also include a plurality of recesses 80 that at least partially receive posts 76. In the present embodiment, a sole recess 78 and a crown recess 80 combine to form a recess that generally complements the shape of a post 76 so that when the crown member 64 and sole member 62 are combined and joined together the posts closely fit the combined recesses.

In a method of manufacturing golf club head 60, the sole member 62 and the crown member 64 are oriented so that the perimeters of the components are located adjacent each other, so that the sole recesses 78 align with the crown recesses 80 and combine to form a weight aperture. The perimeters of the sole member 62 and the crown member 64 are joined, such as by a weld or a brazed joint. The weld couples the perimeters of sole member 62 and crown member 64 while trapping posts 76 in the combined recesses. The posts 76 may include mechanical features, such as a circumferential channel or undercut that may be mechanically held by the weld that also couples the sole member 62 and the crown member 64. As an alternative or in addition to the welding or brazing, the posts may be deformed after insertion into the recesses to form a riveted connection. In particular the posts are deformed to include an end having an outer dimension greater than the inner dimension of the combined recesses, or weight apertures, to provide a riveted connection.

Figure 6:
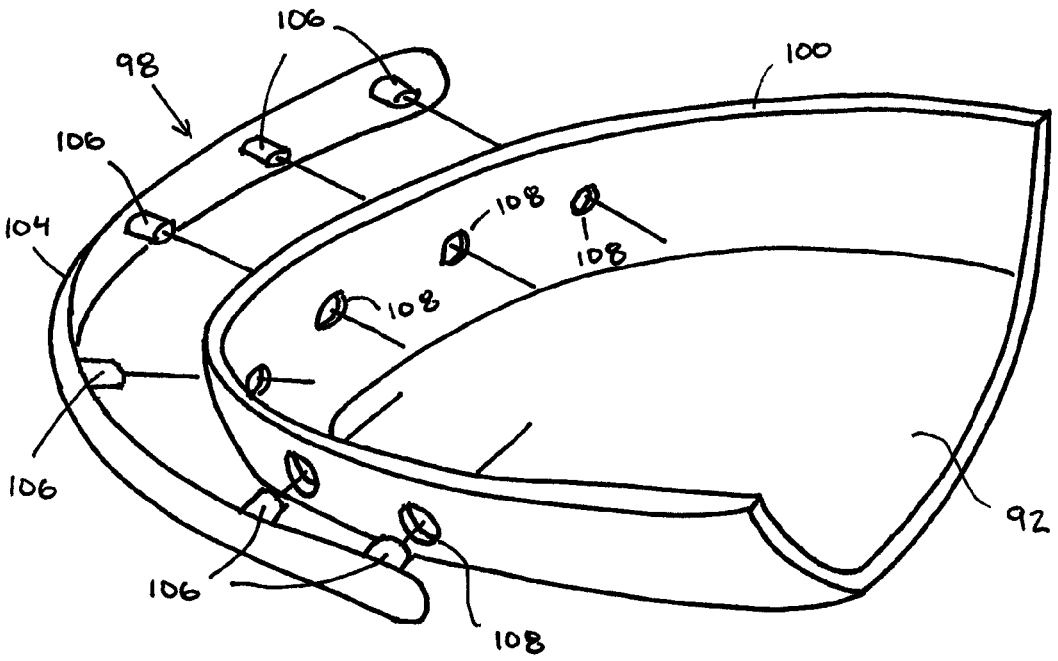
FIG. 6 is a perspective view of an alternative construction of a sole member and weight member.
Figure 7:
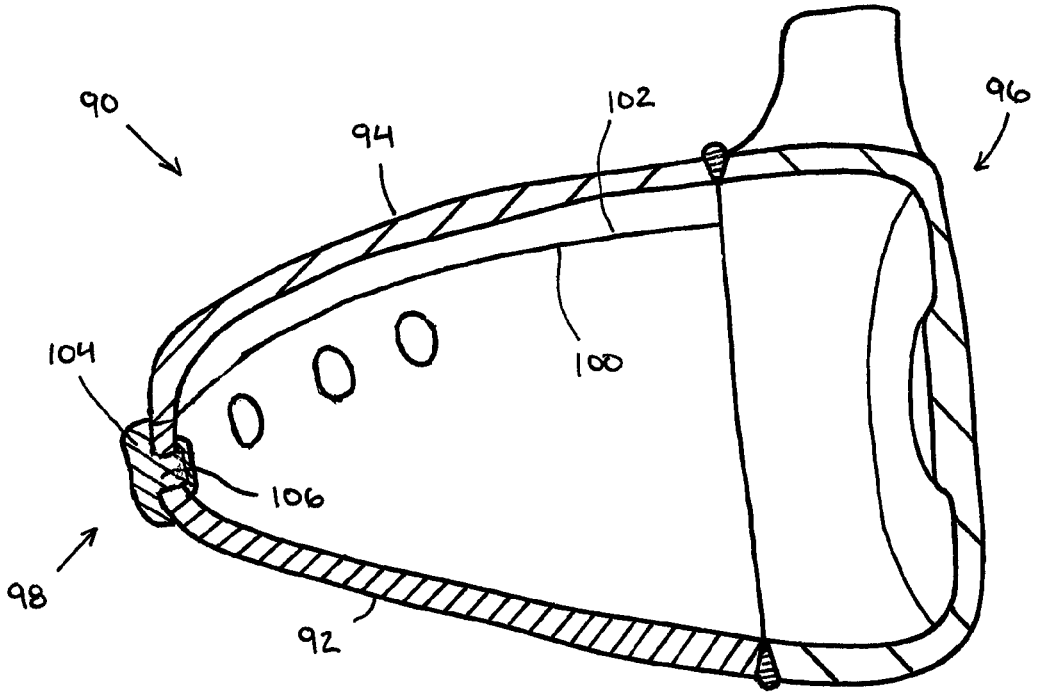
FIG. 7 is a cross-sectional view of a golf club head including the sole member and weight member of FIG. 6.

Another embodiment of a golf club head including a weight member is shown in FIGS. 6 and 7. Golf club head 90 has a construction similar to that of golf club head 60 described above, but the attachment of weight member is modified. Golf club head 90 includes a sole member 92, a crown member 94, a hitting face member 96, and a weight member 98 that are joined to form a hollow bodied golf club head. Sole member 92 generally provides a sole surface of the golf club head 90, and includes a perimeter edge 100. Crown member 94 forms an upper surface of golf club head 90 and includes a perimeter edge 102 that is at least partially joined with sole member 92 at perimeter edge 100 to form a seam. The face member 96 has a cup-face construction similar to that described with regard to golf club head 10.

Weight member 98 is a concentrated mass piece that is coupled to the golf club body so that it overlaps the seam. In the present embodiment, the mounting of weight member 98 is disposed adjacent the seam. Weight member 98 includes an elongate body 104 and a plurality of posts 106. Sole member 92 includes a plurality of recesses 108, or weight apertures, that are sized and shaped to complement posts 106. During the manufacture of golf club head 90, the posts 106 of weight member 98 are inserted into recesses 108 and coupled to sole member 92. Post 106 is preferably coupled to sole member 92 using a metallurgical joining technique such as welding, or brazing. As an alternative or in addition to the welding or brazing, the posts may be deformed after insertion into the recesses to form a riveted connection. In particular the posts are deformed to include an end having an outer dimension greater than the inner dimension of the combined recesses, or weight apertures, to provide a riveted connection.

As a further alternative, posts 106 may include mechanical locking features such as a circumferential channel that functions in conjunction with the welding or brazing to create a mechanical lock. The weight member 98 may be attached to sole member 92 before or after sole member 92 is coupled to crown member 94. Preferably, recesses 108 are located within 20 mm of the perimeter 100 of sole member 92, and more preferably within 10 mm of perimeter 100.

Figure 8:
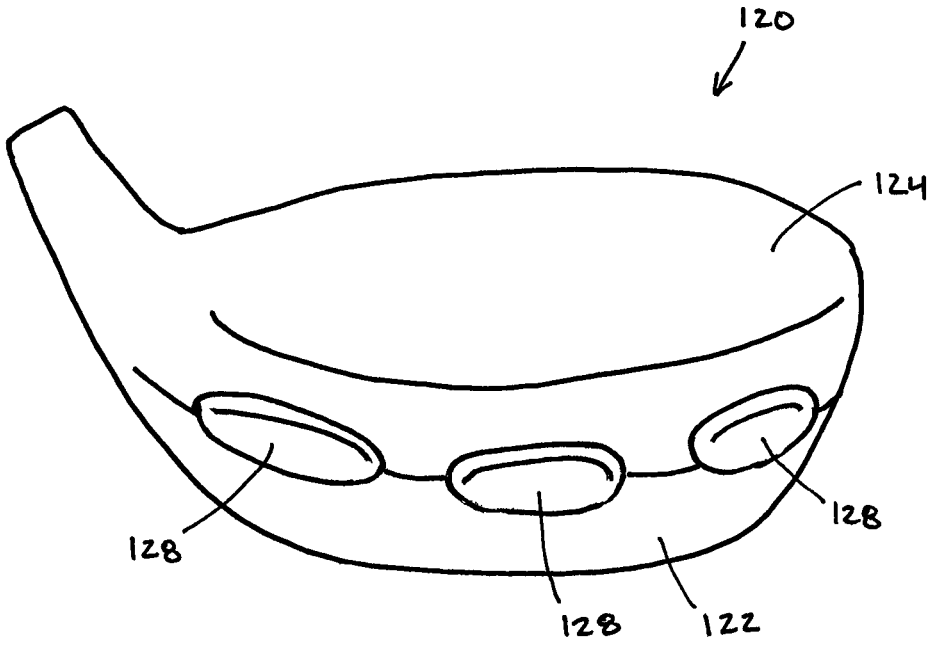
FIG. 8 is a rear view of a golf club head of the present invention including a plurality of weight members.
Figure 9:
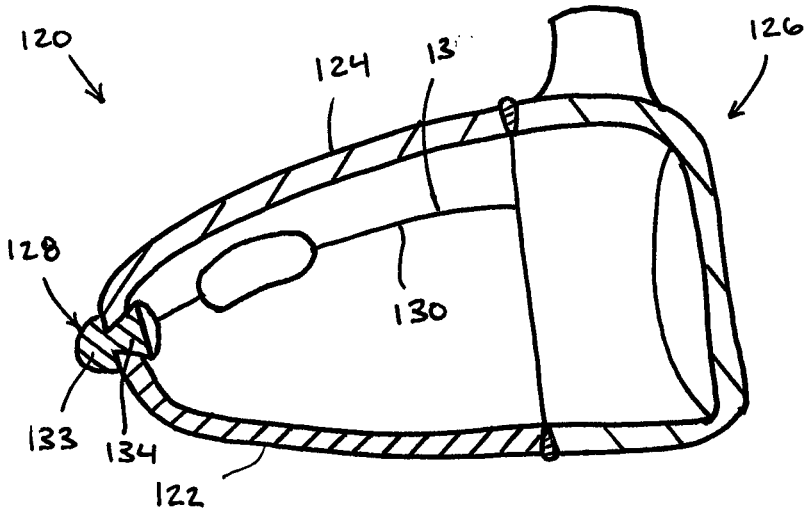
FIG. 9 is a cross-sectional view of a portion of the golf club head and weight members of FIG. 8.
Figure 10:
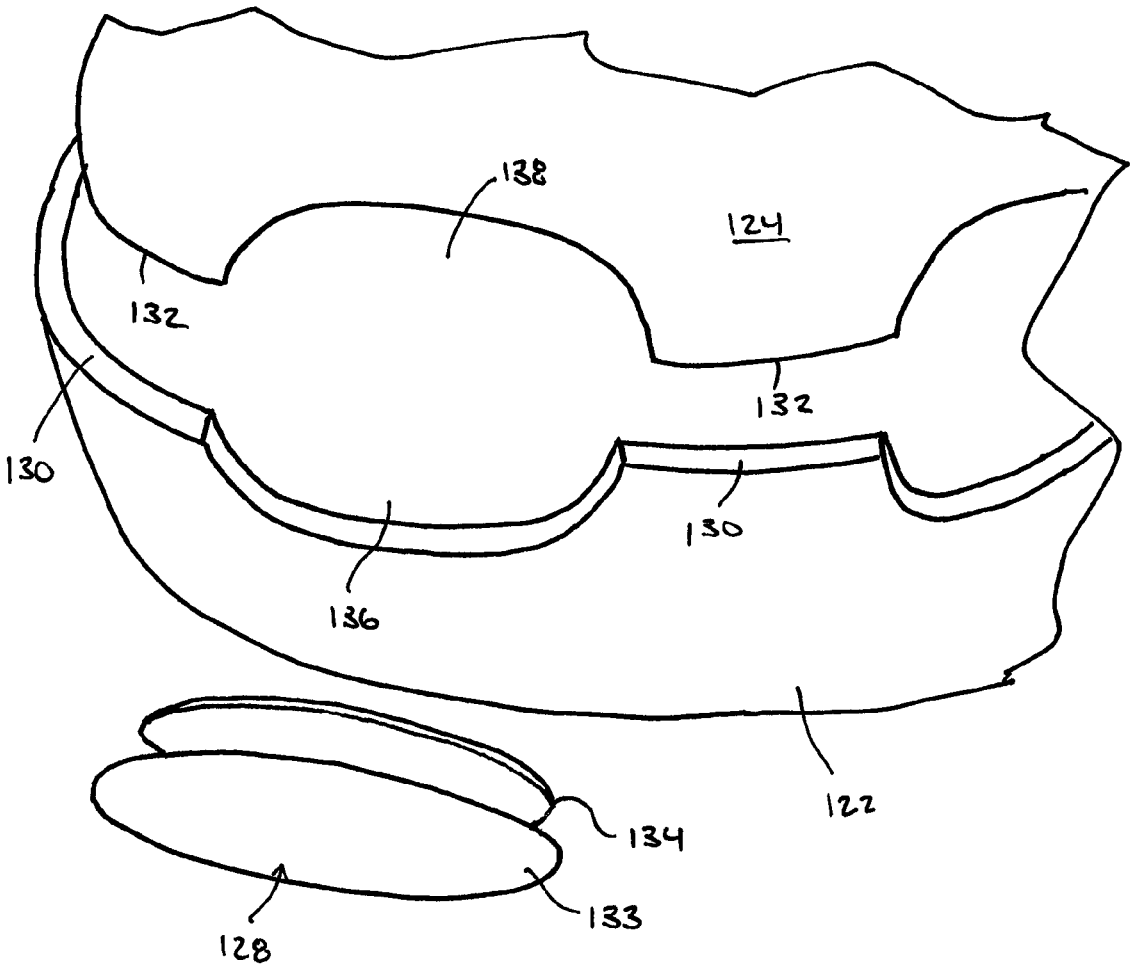
FIG. 10 is a rear exploded view of a portion of the golf club head of FIG. 8.

In another embodiment, a golf club head includes a plurality of weight members, as shown in FIGS. 8-10. Golf club head 120 includes a sole member 122, a crown member 124, a hitting face member 126, and a plurality of weight members 128 that are joined to form a hollow bodied golf club head. Sole member 122 generally provides a sole surface of the golf club head 120, and includes a perimeter edge 130. Crown member 124 forms an upper surface of golf club head 120 and includes a perimeter edge 132 that is at least partially joined with sole member 122 at perimeter edge 130 to form a seam. The face member 126 has a cup-face construction similar to that described with regard to golf club head 10.

Each weight member 128 is a concentrated mass piece that is coupled to the golf club body so that it overlaps the seam, and in the present embodiment is integrated into the seam. In particular, the seam creates a mechanical lock for retaining weight member 128. In particular, weight member 128 includes an exposed body 133 and a flange 134 that extends into and is coupled to the head at the seam between sole member 122 and crown member 124. Flange 134 of weight member 128 is an elongate extension of weight member 128 that forms an elongate undercut dovetail on wall of weight member 128.

Sole member 122 includes a plurality of recesses 136 that at least partially receive the flanges 134 of weight members 128. Crown member 124 also includes a plurality of recesses 138 that at least partially receive flanges 134. In the present embodiment, a sole recess 136 and a crown recess 138 combine to form a weight aperture that is a recess that generally complements the shape and size of the undercut portion of flange 134 so that when the crown member 124 and sole member 122 are combined and joined together the flange closely fits the combined recess and a weight member 128 is captured.

In a method of manufacturing golf club head 120, the sole member 122 and the crown member 124 are oriented so that the perimeters of the components are located adjacent each other, so that the sole recesses 136 align with the crown recesses 138. The perimeters of the sole member 122 and the crown member 124 are joined, such as by welding or brazing. The weld couples the perimeters of sole member 122 and crown member 124 while trapping flanges 134 in the combined recesses.

Figure 11:
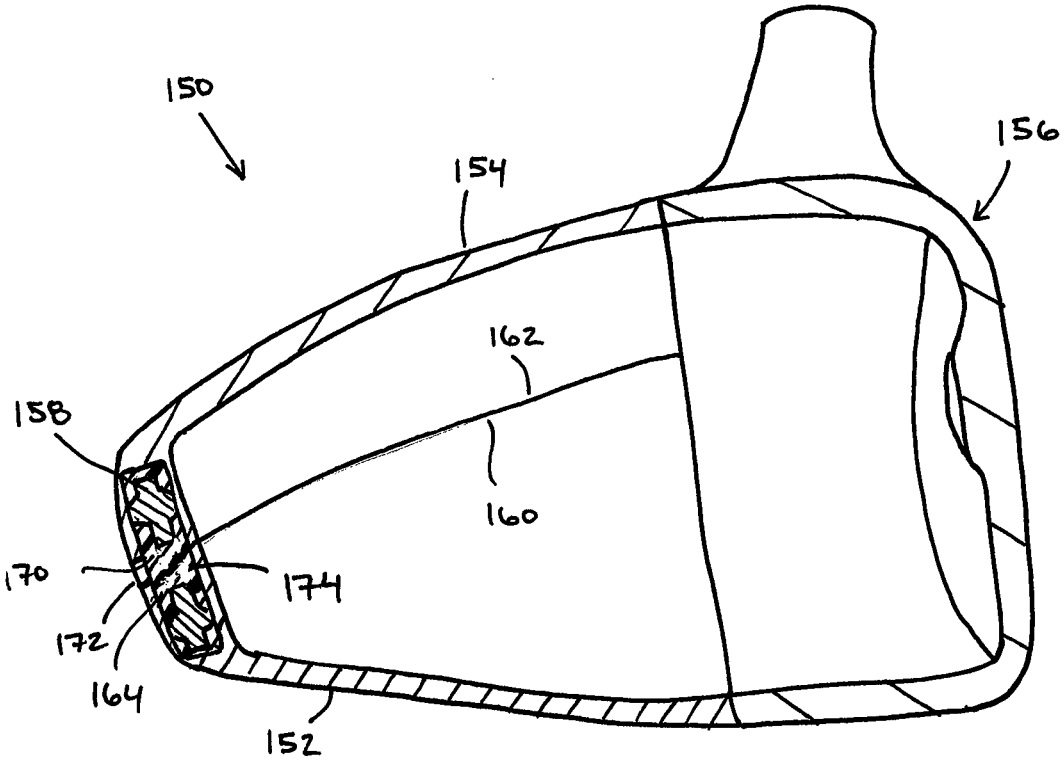
FIG. 11 is a cross-sectional view of another golf club head according to the present invention.
Figure 12:
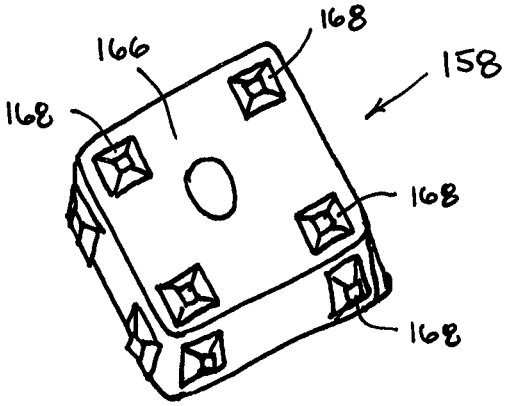
FIG. 12 is a perspective view of a weight member of the golf club head of FIG. 11.

In another embodiment, a golf club head includes a weight member disposed in a chamber, as shown in FIGS. 11-12. Golf club head 150 includes a sole member 152, a crown member 154, a hitting face member 156, and a weight member 158 that are joined to form a hollow bodied golf club head. Sole member 152 generally provides a sole surface of the golf club head 150, and includes a perimeter edge 160. Crown member 154 forms an upper surface of golf club head 150 and includes a perimeter edge 162 that is at least partially joined with sole member 152 at perimeter edge 160 to form a seam. The face member 156 has a cup-face construction similar to that described with regard to golf club head 10.

Each of sole member 152 and crown member 154 include an interior shoulder wall and an exterior wall that combine to form a double walled portion and those double walled portions combine to form a cavity 164 that receives weight member 158. During manufacture, the weight member 158 is positioned inside the cavity 164 and the sole member 152 and crown member 154 are joined to trap weight member 158 permanently inside cavity 164.

Weight member 158 is generally constructed from a weight body 166 and a plurality of projections 168. Weight body 166 provides a majority of the mass of weight member 158 and is generally constructed from a material having a higher specific gravity than the materials of either the sole member 152 or the crown member. Because of that material difference, oftentimes weight member is not weldable to sole member 152 and/or crown member 154 and after the weight member is trapped in cavity 164 it is still able to move relative to the crown and sole members. A combination of projections 168 and an encasing material 170 is used to limit that relative movement.

Projections 168 create a controlled separation from the surrounding cavity to allow better flow of the encasing material to provide equal dispersion of the encasing material. Projections 168 extend outward from weight body 166 and create space between weight body 166 and the interior walls of cavity 164. A low durometer encasing material 170, such as hot-melt glue, is injected into the space between weight body 166 and the inner walls of cavity 164 through an aperture 172 that is provided in outer wall of the golf club head 150.

Additionally, one or more weight apertures 174 may be included through weight body 166 to allow the encasing material to flow through weight body 166 and fully into cavity 164. Additionally, a lubricant, such as silicone, may be provided on the surfaces of the cavity 164 and weight member 158 to improve the flow of the encasing material 170.

Figure 13:
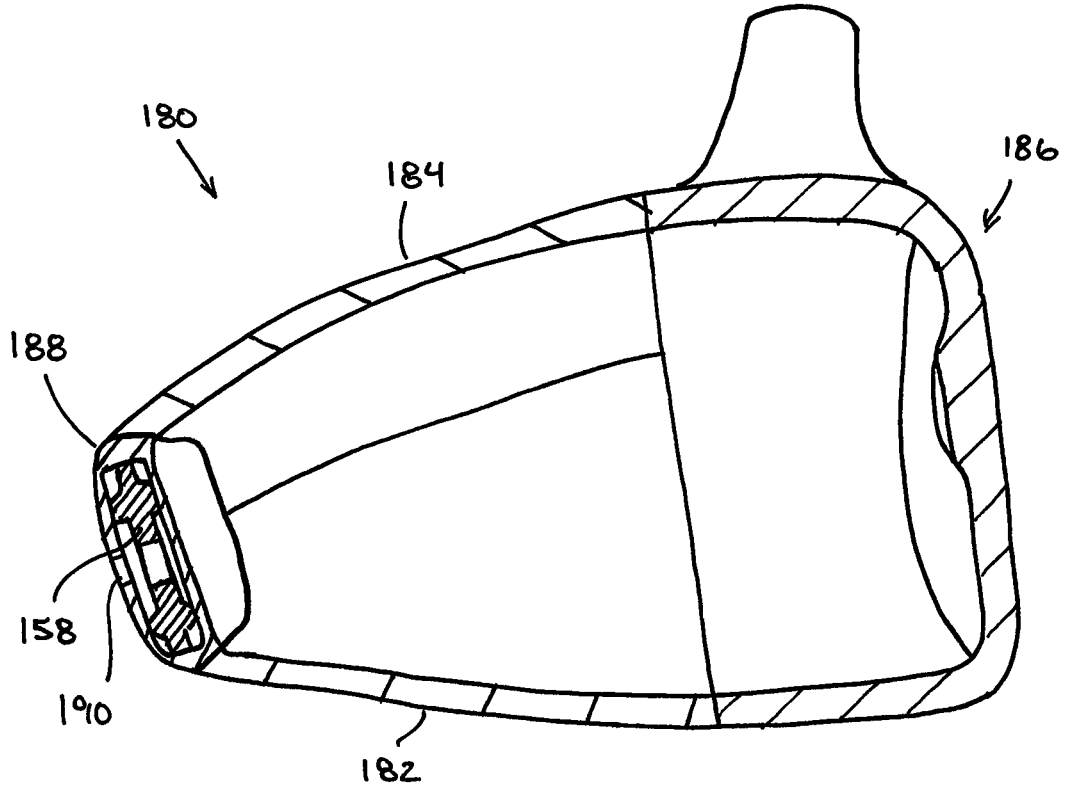
FIG. 13 is a cross-sectional view of another golf club head according to the present invention.
Figure 14:
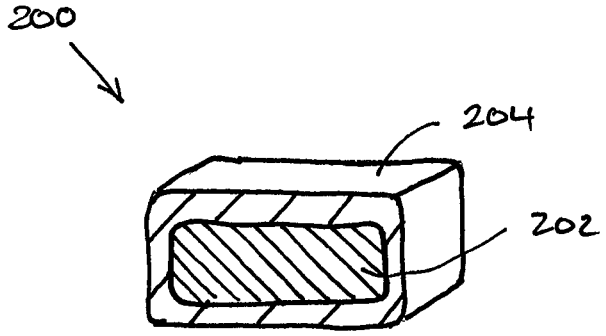
FIG. 14 is a cross-sectional view of a weight member according to the present invention.

In a related embodiment, illustrated in FIG. 13, a golf club head 180 includes a sole member 182, a crown member 184, a hitting face member 186, a weight housing 188, and a weight member 158 having the same construction as shown in FIG. 12. In the present embodiment, weight member 158 is encased in weight housing 188 which is constructed to be metallurgically coupled to the adjacent body components, and an encasing material is injected into weight housing 188 through an aperture 190 in housing 188. For example, in an embodiment having a sole member 182 constructed of titanium and a crown member 184 constructed of titanium, the weight housing 188 is preferably also constructed of titanium or another material weldable to titanium. In such an embodiment, weight member 158 is constructed of a higher density material that is not weldable to either the weight housing 188 or adjacent components. Although the present embodiment is illustrated with the weight housing and weight member located generally along the skirt of the golf club head 180, it should be appreciated that the weight housing may be coupled to any portion of the golf club head.

In embodiments in which it is desirable to include a weight member that is high density and weldable, there are preferred manufacturing methods and material choices for the weight member. For example, a height density weight material, such as tungsten, may be encased by a weldable material for incorporation into a golf club head. In another example, a high density, weldable metal material, such as molybdenum, may be incorporated into a golf club head construction.

Welding is easily accomplished when the two surfaces to be joined are similar metallurgically. For example, welding of a steel component to another steel component is accomplished easily, as is welding of a titanium component to another titanium component. For the purposes of this invention a weight assembly 200 is constructed from a high density weight component 202 formed from a high refractory material, such as a tungsten based weight component, that is encased in a titanium or steel enclosure 204. The enclosure may then be attached to another component of a golf club head using standard welding processes such as TIG welding, plasma welding or laser welding. The tungsten weight component may be incorporated into the enclosure using methods such as press fitting, shrink fitting or other mechanical methods. In general, the present invention includes incorporating a powder mixture of tungsten into the enclosure so that the liquid phase of the mixture bonds to the inner surface of the enclosure.

Tungsten is a highly refractory metal so it demonstrates a very high melting point. As a result, tungsten components, and components of its alloys, are not fabricated in traditional methods of melting and casting, but instead they are generally produced using powder metallurgy techniques. Powder metallurgy techniques generally utilize powder mixtures that are consolidated into net shape using pressure and temperature to sinter the powder materials together. In particular, when the consolidation process utilizes the melting of the additive metal powders it is known as liquid phase sintering.

The amount of tungsten powder and the additive amount in the mixture is determined by the desired final density and geometry. The powders are mixed together and then pressed into a compact, and the compact is configured to have a desired shape. An organic binder may be added to improve the strength of the powder compact. If an organic binder is added then it is removed during a burnout process that takes place in a burnout oven. The compact is then heated in a sintering oven for further consolidation.

During the process of sintering the material particles attach to each other and grow point contacts into surfaces. Sintering relies upon diffusion of atoms to grow the contacts. The solid state diffusion is a slow process, but the sintering process can be improved if a liquid phase is present. The liquid phase also helps to reduce the porosity of the final product.

In an example of the inventive process, a high density weight component having a desired mass and geometry is determined. Based on that determination, the amounts of high density powder, such as tungsten powder, and a sintering aid material, i.e., the material forming the liquid phase, is calculated. A powder compact is then made by mixing the powders and pressing them in a die. The enclosure is then at least partially constructed from a desired weldable material, such as steel or titanium, by machining, casting, stamping, drawing forming or any other suitable process so that it forms a cavity configured to receive the powder compact. The pressed compact is then placed in the partial enclosure and the combined enclosure and compact are put into a sintering furnace. As an alternative, the enclosure may be placed in a die and the powder mixture pressed directly into the enclosure to form a compact. Furthermore, in such a process the enclosure is configured to shrink upon the consolidated tungsten mixture upon cooling to further mechanically lock it into place. If an organic binder is used to facilitate the pressing step then the entire assembly will be put in a debindering oven before being transferred to the sintering furnace. Liquid metals are typically very reactive bond relatively easily, so during the sintering process the liquid phase consolidates the compact and bonds the compact to the enclosure. A protective atmosphere, such as a vacuum, may be used to achieve high quality sintering. After the sintering process is complete, any excess material remaining from the enclosure or the compact can be ground off to make the surface flat for welding. Additionally, after sintering, when the enclosure cools, it will shrink on the consolidated mixture and mechanically lock it into place.

The type of additive used to form the liquid phase is selected depending on the material used for the enclosure. For example, when the outside enclosure is made from titanium alloys, materials such as nickel, nickel-iron or copper based compositions can be used as the liquid phase because the melting temperature of titanium is higher than that of any of the liquid phase components. When the outside enclosure is made from steel, materials such as nickel or nickel-iron alloys cannot be used as liquid phase formers. However, copper or copper based alloys may be used to form the liquid phase in steel enclosures because the melting temperature of nickel and nickel alloys are very close to that of steel, but the melting temperature of copper is lower than that of steel.

It should also be appreciated that in another embodiment, the compacting and sintering process may be performed in multiple stages. In particular, sintering results in shrinkage of the compact, so additional stages that include adding additional powder mixture may be incorporated to accommodate the shrinkage. The additional metal provided would preferably have the same compositions as the liquid phase forming metal alloy.

In another embodiment, molybdenum metal is utilized to form concentrated weighting. As examples, molybdenum may be welded directly to titanium or it may be utilized as a high density weight component encased by an enclosure, such as enclosure 204. In the encased embodiment, the weldability of molybdenum in a titanium enclosure improves the metallurgical bond between the components. Molybdenum has a high density, i.e., 10.22 g/cc, which is more than twice that of titanium. As a result, it is possible to concentrate a large mass in a small area.

Molybdenum is ductile so it can be formed to match complex curvatures included on many portions of golf club heads, but it is hard enough to be finished to a high polish, dent and scratch resistant. Molybdenum is also corrosion resistant. Furthermore, molybdenum is known to be a beta stabilizer in titanium alloys and as such alloys well with titanium. During welding when liquid titanium comes in contact with molybdenum a strong metallurgical bond is formed. Additionally, moldybdenum is not as expensive as other high density materials such as tantalum, hafnium or rhenium.

The molybdenum weight component may be cold or warm formed in a die to match the contour with the golf club head. Preferably, after forming the surfaces to be welded are cleaned to remove organic contaminants. Further, it is preferred that welding of the molybdenum weight component to the titanium body be performed in a protective environment, such as under a shroud of protective noble gas, such as argon, to prevent oxidation of the hot surfaces and to facilitate a sound metallurgical bond between the molybdenum, the filler material and the golf club head component. After welding the weight component may be finished, which may include painting.

In addition to molybdenum, tantalum (Ta), and hafnium (Hf) may also be used. Both of those elements form isomorphous system with titanium and thus alloy readily with titanium. As a result, it is possible to weld those metals to titanium. Hafnium has a density of 13.4 g/cc and tantalum has a density of 16.6 g/cc providing more options with regard to weighting member.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A golf club head, comprising:

a hosel;

a ball striking face member;

a sole member extending aftward from a lower edge of the face, wherein the sole member defines a perimeter edge, wherein a portion of the perimeter edge includes a shoulder that is recessed toward the interior of the golf club head;

a crown member extending aftward from an upper edge of the face, wherein the crown member defines a perimeter edge, wherein a portion of the perimeter edge includes a shoulder that is recessed toward the interior of the golf club head, wherein the perimeter edge of the crown member is coupled to the perimeter edge of the sole member to form a seam, and wherein the shoulder of the sole member combines with the shoulder of the crown member to form an elongate weight recess; and a weight member, wherein the weight member includes a portion that extends into the weight recess, wherein the weight member includes a weight body and a plurality of projections extending outward from an outer surface of the weight body, wherein the projections space the weight body from an interior surface of the weight cavity.

2. The golf club head of claim 1, wherein the sole member includes an exterior wall portion disposed at the perimeter edge and spaced from the shoulder that combines with the shoulder to form a double walled portion, wherein the crown member includes an exterior wall portion disposed at the perimeter edge that combines with the shoulder to form a double walled portion.

3. The golf club head of claim 2, wherein the double walled portion of the sole member aligns with the double walled portion of the crown member to define a weight cavity, and wherein the weight member is disposed inside the weight cavity.

4. The golf club head of claim 1, further comprising an encasing material disposed in the space between the weight body and the interior surface of the weight cavity.

5. The golf club head of claim 1, wherein the weight body includes an aperture extending through the thickness of the weight body.

* * * * *